US007523596B2

(12) United States Patent
Dovesi

(10) Patent No.: US 7,523,596 B2
(45) Date of Patent: Apr. 28, 2009

(54) METHOD FOR PACKAGING OF PHIALS IN A STERILE ENVIRONMENT, AND APPARATUS FOR CARRYING OUT THE AFORESAID METHOD

(76) Inventor: Pietro Dovesi, Via G. Leopardi 3, Pianoro (Bologna) (IT) 40065

( * ) Notice: Subject to any disclaimer, the term of this patent is extended or adjusted under 35 U.S.C. 154(b) by 0 days.

(21) Appl. No.: 11/685,865

(22) Filed: Mar. 14, 2007

(65) Prior Publication Data

US 2007/0214748 A1 Sep. 20, 2007

(30) Foreign Application Priority Data

Mar. 15, 2006 (IT) ..... BO2006A0183

(51) Int. Cl.

| | |
|---|---|
| ***B67C 7/00*** | (2006.01) |
| ***B65B 55/10*** | (2006.01) |
| ***B65B 31/02*** | (2006.01) |
| ***B65B 3/00*** | (2006.01) |
| ***B65B 7/28*** | (2006.01) |

(52) U.S. Cl. ..... 53/425; 53/432; 53/471; 53/167; 53/510; 53/282

(58) Field of Classification Search ..... 53/425, 53/432, 167, 510, 471, 281, 282; *B65B 55/10; B67C 7/00*
See application file for complete search history.

(56) References Cited

U.S. PATENT DOCUMENTS

| | | | | | |
|---|---|---|---|---|---|
| 3,477,192 | A | * | 11/1969 | Brown et al. | 53/432 |
| 4,208,852 | A | * | 6/1980 | Pioch | 53/167 |
| 4,693,052 | A | * | 9/1987 | Rebmann et al. | 53/167 |
| 4,707,334 | A | * | 11/1987 | Gerhard | 422/28 |
| 4,880,581 | A | * | 11/1989 | Dastoli et al. | 264/39 |
| 5,020,303 | A | * | 6/1991 | Vokins | 53/432 |
| 5,069,366 | A | * | 12/1991 | Graffin | 222/152 |
| 5,687,542 | A | * | 11/1997 | Lawecki et al. | 53/122 |
| 5,799,464 | A | * | 9/1998 | Olsson | 53/425 |
| 5,848,515 | A | * | 12/1998 | Catelli et al. | 53/167 |
| 6,619,901 | B1 | * | 9/2003 | Duethorn et al. | 414/217 |
| 2005/0223677 | A1 | * | 10/2005 | Py | 53/140 |
| 2006/0075721 | A1 | * | 4/2006 | Monti | 53/167 |
| 2006/0086065 | A1 | * | 4/2006 | Tomalesky et al. | 53/425 |
| 2006/0185321 | A1 | * | 8/2006 | Raynaud | 53/167 |

FOREIGN PATENT DOCUMENTS

EP 0089613 A1 9/1983

(Continued)

OTHER PUBLICATIONS

European Patent Office Search Report for application EP07104108 dated Jun. 18, 2007.

*Primary Examiner*—Stephen F Gerrity
(74) *Attorney, Agent, or Firm*—William J. Sapone; Coleman Sudol Sapone P.C.

(57) ABSTRACT

The method for packaging of phials in a sterile environment comprises, subsequently: moving of each empty phial (1), according to a forwarding direction (K), from an input section toward a filling station (R); inserting of a dosed quantity of pharmaceutical products (F) inside the phial (1); transporting the filled phial (1) toward a closing station (8); closing said phial (1). It is moreover provided that a first laminar flow (H) of sterilized air, having a horizontal direction, is applied at least to the upper edges (1*h*) which define corresponding input mouths of the phials (1), at least during the aforesaid phases of filling and closing of phials (1), as well as during their transfer from the filling station (R) to the closing station (8).

6 Claims, 3 Drawing Sheets

FOREIGN PATENT DOCUMENTS

| | | | | |
|---|---|---|---|---|
| EP | 96336 | A2 | * | 12/1983 |
| EP | 1447328 | A2 | | 8/2004 |
| JP | 01254520 | A | * | 10/1989 |
| JP | 02045323 | A | * | 2/1990 |
| WO | WO2004/076288 | A | | 9/2004 |
| WO | WO2005/087592 | A | | 9/2005 |

* cited by examiner

METHOD FOR PACKAGING OF PHIALS IN A STERILE ENVIRONMENT, AND APPARATUS FOR CARRYING OUT THE AFORESAID METHOD

The present invention fits into that technical sector relating to the apparatus for packaging or phials or similar containers, as ampoules or bottles, with pharmaceutical products, working in a sterile environment.

The provisions currently operating in the aforesaid technical sector require that the phials, once they have been washed and sterilized in a first pollution-controlled chamber, are transferred to the subsequent filling and closing operating stations while being continuously submitted to a constant, laminar air flow. The air must be filtered and decontaminated before to be flown through the sterilized phials, until these latter are closed by a suitable cap. More particularly, it is provided that the sanitized air flow is directed at least toward the upper phial edge, which defines a corresponding inlet from which the phial is filled with the pharmaceutical products.

This second chamber, wherein the filling and closing operations occur, has to be controlled for pollution as well, and it has to be subject to strict sterility and cleanliness conditions.

In known apparatus of the type described above the laminar air flow is generated so as it is constant, vertical and oriented top-down. The air flow reaches the phials mouth only when the phials are moving toward the filling station, and between this latter and the closing station. When the phials are submitted to filling and closing operations at these stations, in fact, the filling and closing devices thereof shields the laminar air flow directed toward the underlying phials, thus modifying the laminar flow status and creating some turbulence near the phials transporting path. This results in undesired effects, as moving residual particles from the conveyor and operating stations surfaces, which are well known to the people skilled in that sector.

From the above considerations emerges that the phials packaging apparatus that are currently manufactured do not optimally comply to the national and international provisions for pollution and contamination prevention in packaging of sterile products. The current provisions set that a constant laminar air flow with very low particles density values, flowing into a substantially sterile environment (i.e. having a number of polluting particles, microbes and other contaminating substances per volume unit which is lower than a predefined value, as stated by the international regulations for the matter of packaging pharmaceutical products), must affect at least the upper phial edges both while they are transferred to and stay in the filling and closing stations.

The main object of the present invention is then to provide a method for packaging of phials or similar containers in a sterile environment which, when carried out, allows all the aforesaid provisions to be complied with, thus overcoming the drawbacks that are inborn in the known art packaging apparatus.

Another object of the present invention is to provide a method for packaging of phials in a sterile environment which is effective, essential, functional, reliable and whose manufacturing costs are reasonably low with respect to the results that can be attained.

A further object of the present invention is to provide an apparatus for packaging of phials in a sterile environment which, when manufactured and operating, allows all the aforesaid provisions to be complied with, thus overcoming the drawbacks that are inborn in the known art packaging apparatus.

A further object of the present invention is to provide a packaging apparatus of simple conceiving, and which is also reliable, functional and whose manufacturing costs are reasonably low with respect to the attained results.

All the aforesaid objects are satisfied in accordance with the invention, by a preferred embodiment of an apparatus for packaging of phials in a sterile environment, cooperating with a conveying line of said phials, wherein said line is moving according to a given transporting direction. The aforesaid apparatus comprises: a filling station, cooperating with said conveying line, fit to put a dosed amount of pharmaceutical products inside each of said phials located at the said filling station; and a closing station for applying a cap to each of said filled phials, cooperating with said conveying line and arranged downstream of said filling station with respect to said forwarding direction. The above apparatus also comprises a first air flow generator, for generating a first laminar flow of sterilized air, oriented at a given angle with respect to a horizontal surface and fit to affect constantly at least the upper edges defining corresponding input mouths of said phials, at least during said phials filling and closing phases, as well as during their transfer between said filling station and said closing station.

In accordance with a preferred embodiment of a method for packaging of phials in a sterile environment, the phials filling and closing phases subsequently comprise:

moving each one of said phials, when empty, along the conveying line and according to a forwarding direction, from a line input section to a line output section, towards a filling station;

filling each phial, at the aforesaid filling station, with a predefined amount of pharmaceutical products;

transporting each one of said phials, once filled, towards a closing station;

closing, at said closing station, said phials filled with said pharmaceutical products;

moving each one of said filled and closed phials towards an output section;

applying a first laminar flow of sterilized air, oriented at a given angle with respect to a horizontal surface, at least to the upper edges of said phials at least during said phases of filling and closing said phials, as well as during their conveying toward said filling station and said closing station.

All the characteristic features of the present invention, even not coming out from the above considerations, will be better pointed out in the following, according to the Claims contents and referring to the accompanying drawing tables, wherein:

Referring now to the figures listed above, numeral 10 indicates generically a frame of an apparatus for packaging of phials and similar containers, made according to the present invention. The frame 10 comprises a plurality of frame walls 10*h*, 10*j*, 10*k* and some structural components 10*k* which define, together with to some other operating units of the same apparatus, that will be detailed later, a first sterile chamber A1 and a second sterile chamber A2 (see FIG. 1 and FIG. 2). Even if this is not shown in the Figures, frame walls 10*k* and 10*j* are provided with small doors allowing operators to enter respectively the second sterile chamber A2 and the first sterile chamber A1.

A conveyor line L of known type, operated stepwise, carries a plurality of phials 1 according to a forwarding direction K, into the first sterile chamber A1 first, and then into the second sterile chamber A2.

The conveyor line L comprises one input branch L1 and one output branch L3, that lay in the second sterile chamber A2, and that are functionally connected to a rotating ring conveyor L2, also being part of the conveyor line L. The rotating ring conveyor L2 affects both the first sterile chamber A1 and the second sterile chamber A2, by means of an opening O made in the separation wall 10*j* (see FIGS. 1, 2, 3).

The opening O is shaped so as to allow the rotating ring conveyor L2 to operate between the first sterile chamber A1 and the second sterile chamber A2, and also to allow the phials 1 provided by the input branch L1 to pass into the first sterile chamber A1 and the phials 1 to come out from the first sterile chamber A1 towards the output branch L3.

The apparatus according to the present invention, as known, is interposed between other functional units which are not interesting in understanding the invention. Therefore, FIG. 1 does not show these functional units at all, and the input branch L1 and output branch L3 of the conveyor line L are cut respectively downstream and upstream of said functional units.

Figure 1:
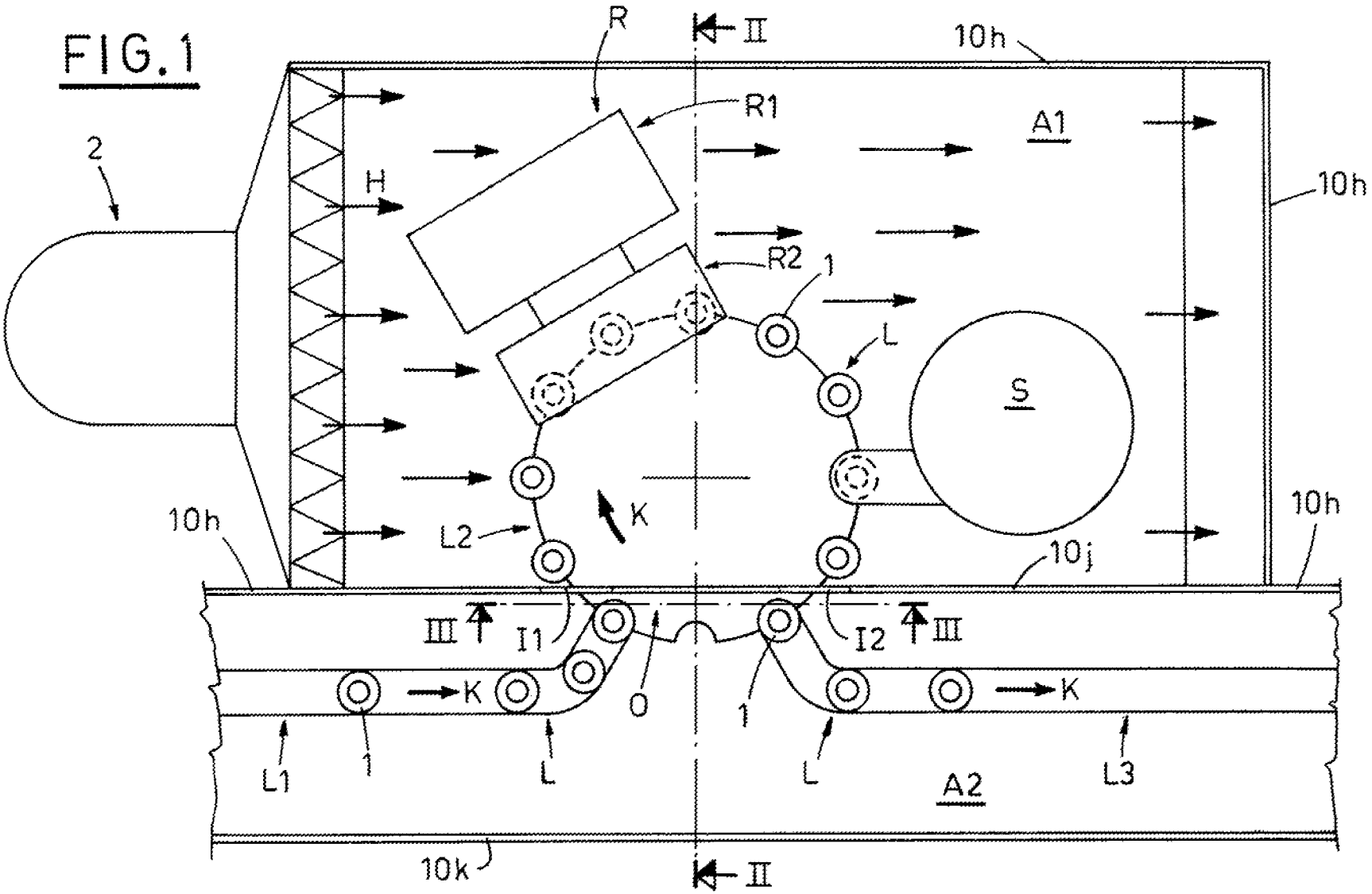
FIG. 1 is a schematic and partial plain view of an apparatus for, packaging of phials and similar containers which is the object of the present invention.
Figure 2:
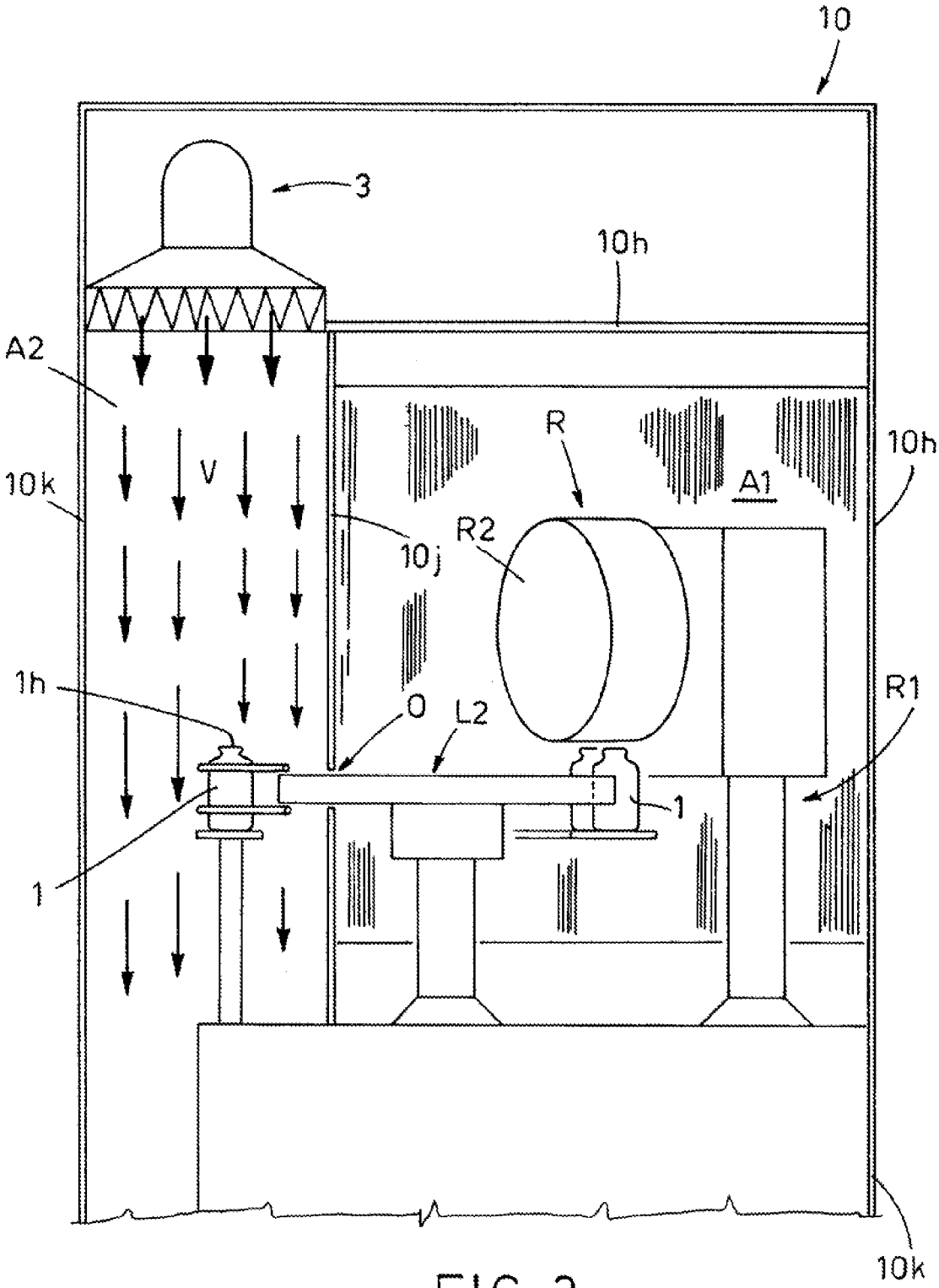
FIG. 2 is a schematic view according to section line II-II of FIG. 1.
Figure 3:
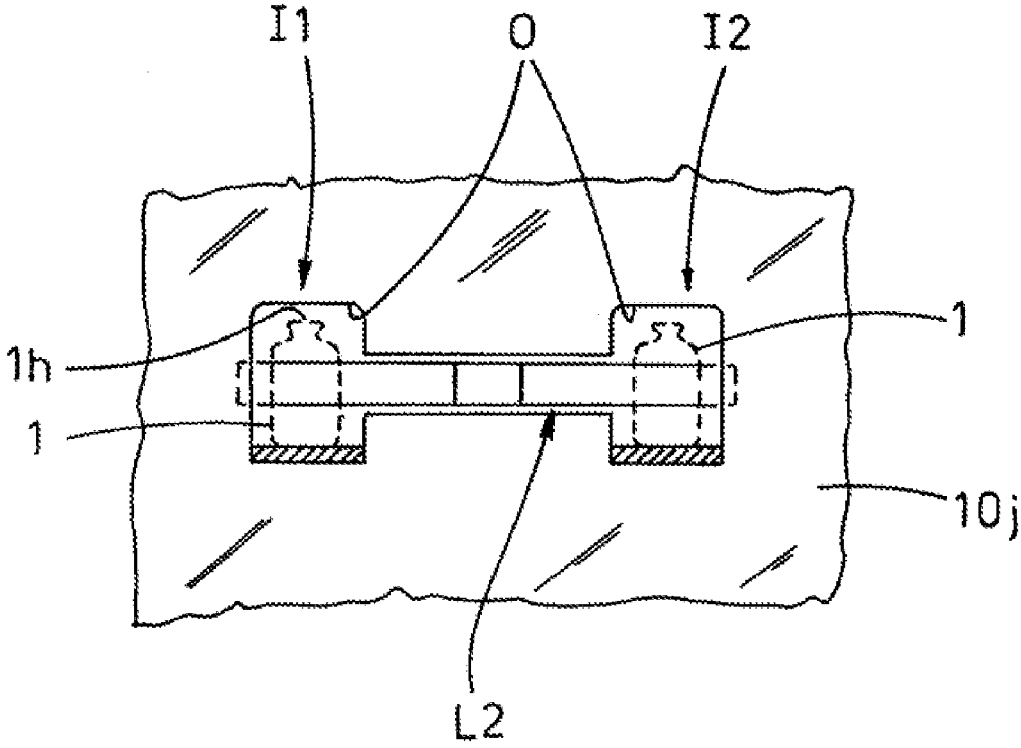
FIG. 3 is a schematic view according to section line III-III of FIG. 1.
Figure 4:
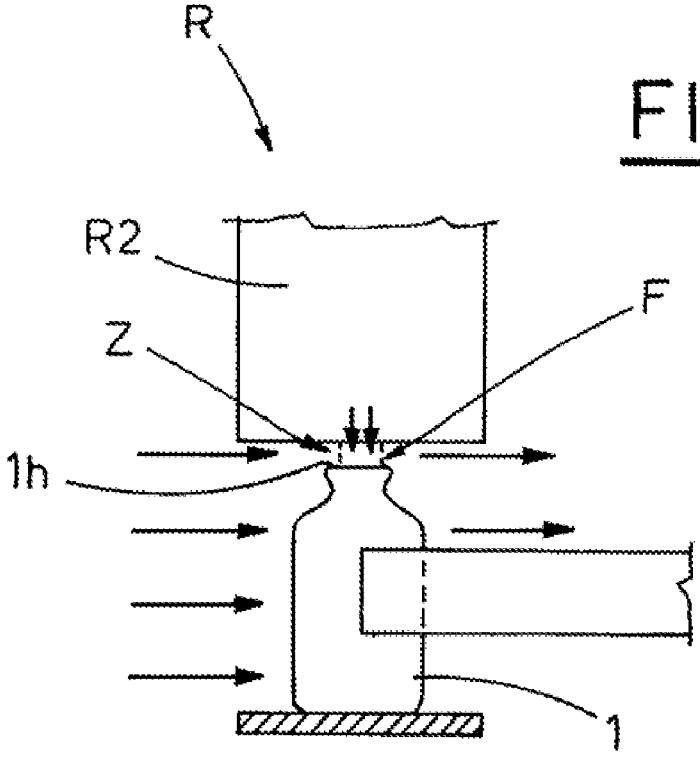
FIG. 4 shows, at an enlarged scale with respect to the previous Figures, a phial during an operating phase of the apparatus according to the present invention which is considered particularly relevant.

A processing station R for dosing pharmaceutical products F and filling with them the incoming phials 1 in a substantially known way cooperates with the rotating ring conveyor L2 inside the first sterile chamber A1; in the example shown in FIG. 1 and FIG. 2 the processing station R comprises a telescopically adjustable tower R1 carrying a dosing disc R2 fit to prepare a dose of pharmaceutical products F and to put them inside the phials 1. The dosing disc R2 is connected to a feeding funnel (not shown) and arranged above the rotating ring conveyor L2.

The height of the dosing disc R2 can be adjusted according to the phials 1 size, so as a gap Z always remains between the disc R2 surface and the upper edge 1*h* of the underlying phials 1. When operating, said disc R2 releases a pre-defined dose of pharmaceutical products F, generally provided in form of a granular or powdery material, into an underlying phial 1 provided by the rotating ring conveyor L2 to the processing station R.

A closing station S for closing the filled phials 1, also of known type, cooperates with the rotating ring conveyor L2 inside the first sterile chamber A1. It is arranged downstream of the filling station R with respect to the phials forwarding direction K. It is fit to close the phials 1, coming from the filling station R, carrying a pre-defined dose of pharmaceutical products F.

A first air flow generator 2, working in the first sterile chamber A1, creates a constant laminar flow H of sterilized air according to a horizontal direction, as illustrated in FIG. 1. The air flow H is fit to affect the phials 1 passing inside the same first sterile chamber A1. More particularly, the air flow H affects the phials upper edges 1*h*, which surround the phials input mouth wherefrom the pharmaceutical products F are introduced inside the phials 1.

As far as it concerns the filling station R and the closing station S, they are arranged in the first sterile chamber A1 so as they don't intercept in any case the horizontal laminar air flow H, even during the operating phase of filling the phials 1 with the pharmaceutical products F. In fact, as already stated above, a gap Z always remains between the lower surface of the dosing disc R2 and the upper edge of each underlying phial 1 being filled in the filling station R.

This gap Z allows a laminar air flow to affect the phial upper edge 1*h*. Moreover, the surfaces of disc R2, as well as all the surfaces of the other structures operating inside the first sterile chamber A1, are suitably jointed one each other in order to prevent the generation of undesired air turbulence effects.

It has to be pointed out that the first air flow generator 2 is part of a known generation and recycling system for sterilized air, not shown in the accompanying figures. The generating and recycling system is fit to set the air flowing into the first sterile chamber A1 to pre-defined temperature and relative humidity conditions, suitable for optimizing the physical status of the doses of pharmaceutical products F being inserted into the phials 1.

A second air flow generator 3 operates in the second sterile chamber A2, generating therein a constant laminar flow of sterilized air V having a vertical direction, and oriented top-down as illustrated in FIG. 2. The second air flow is fit to affect the upper edges 1*h* of the phials both during their conveying along the input branch L1 and to the rotating ring conveyor L2 of the conveyor line L, when the phials 1 are still empty, and from the rotating ring conveyor L2 and along the output branch L3, when the aforesaid phials 1 are full and closed by caps.

From the above description is apparent that the present apparatus for packaging of phials 1 in a sterile environment comprises:

- moving each phial 1 along the conveying line L and according to a forwarding direction K, from the line input section to the line output section;
- applying the second vertical laminar flow V of sterilized air at least to the upper edges 1*h* of phials 1 during their transport between the line input section and a first intermediate position II, placed at the opening O made in the vertical wall 10*j;*
- applying the first horizontal laminar flow H of sterilized air at least to the upper edges 1*h* during their transport between the first intermediate position I1 and a second intermediate position I2, placed at the aforesaid opening O, as well as during the phials stay in the above described filling station R and closing station S;
- supplying, at the filling station R a dosed amount of pharmaceutical products F inside each staying phial 1;
- closing, at the closing station S, the phials filled with said pharmaceutical products F.

The vertical wall 10*j* accomplishes a very important function, as it is a separating element between the first sterile chamber A1 and the second sterile chamber A2, thus keeping always separated the first horizontal laminar air flow H and the second vertical laminar air flow V; this allows to advantageously prevent any undesired air turbulence effect, more particularly along the conveying line L where the phials 1 are transported.

From the above detailed description all the considerable technical and functional advantages of the present invention appear evident; the present apparatus, and the method which it carries out, totally fulfill the requirements of the current provisions for packaging of pharmaceutical products. As already stated before, said provisions state that when they leave the washing and sterilizing chamber, the phials 1 are constantly affected by a constant laminar flow of sterilized air, at least at their upper input mouths 1*h*, until they are closed by corresponding caps at the closing station S. In fact, according to the present invention, phials 1 are always affected by a constant laminar flow of sterilized air during their transport from the input section to the output section of line L, as well as during the filling and closing phases.

A further advantage of the present invention is to provide a simply structured packaging apparatus, which is also reliable, functionally optimized and cost-effective.

Another advantage of the present invention consists in providing a method for phials packaging in a sterile environment which is effective, essential, functional and reliable. All the aforesaid advantageous technical and functional aspects which are typical of the present invention remain even if the first laminar flow H of sterilized air is not properly horizontal, but if it is oriented at a given angle with respect to a horizontal surface.

Moreover, the present invention is intended to comprise also apparatus having filling stations structured differently with respect to the one described above.

Finally, the conveying line L, which has been described as operating step by step, can be indifferently operated continuously.

The invention claimed is:

1. A method for filling and closing phials in a sterile environment comprising:

providing a first sterile chamber and a second sterile chamber which form the sterile environment, the first sterile chamber and the second sterile chamber separated by a wall having an opening therein;

in the second sterile chamber, moving a plurality of empty phials along a first conveying line and at a line input section, transferring each of the empty phials one at a time to a ring conveyor;

using the ring conveyor for moving the empty phials from the second sterile chamber through a first intermediate position into the first sterile chamber, and transporting the empty phials towards a filling station;

filling each phial at the filling station with a pre-defined amount of pharmaceutical products;

transporting each one of said filled phials, using the ring conveyor, towards a closing station;

at said closing station, closing said phials filled with said pharmaceutical products;

using the ring conveyor for moving each one of said filled and closed phials from the first sterile chamber into the second sterile chamber at a second intermediate position as the filled and closed phials advance towards a line output section;

at the line output section, located in the second sterile chamber, transferring the filled and closed phials from the ring conveyor to a second conveying line;

wherein the opening in the wall has a portion of the ring conveyor passing therethrough, the second sterile chamber surrounding the portion of the ring conveyor disposed between the second intermediate position, the line output section where each filled and closed phial is transferred to the second conveying line, the line input section where each empty phial is transferred to the ring conveyor, and the first intermediate position;

applying a first laminar flow of sterilized air in said first sterile chamber, oriented at a horizontal angle at least to the upper edges of said phials at least during the filling and closing of said phials, as well as during their conveying toward said filling station and away from said closing station; and, applying a second vertical laminar flow of sterilized air in the second sterile chamber, oriented top-down, at least to the upper edges of phials during their transport between the first conveyor line, the line input section and the first intermediate position where the phials are loaded onto the ring conveyor, and during transport of the filled and closed phials from the second intermediate position to said line output station and onto said second conveying line.

2. The method according to claim 1, wherein said first laminar flow of sterilized air is oriented horizontally.

3. An apparatus for filling and closing phials in a sterile environment, the apparatus cooperating with a conveying line of said phials, said conveying line moving according to a given transporting direction, said apparatus comprising:

a first sterile chamber and a second sterile chamber forming said sterile environment, the first sterile chamber and the second sterile chamber separated by a wall, the wall having an opening therein a ring conveyor passing through the opening, the ring conveyor having a first portion disposed in the first sterile chamber and a second portion disposed in the second sterile chamber;

a filling station, cooperating with said portion of the ring conveyor disposed in the first sterile chamber, the filling station dosing an amount of pharmaceutical products inside each of phials located at the said filling station;

a closing station for applying a cap to each of said filled phials, cooperating with said portion of said ring conveyor disposed in said first sterile chamber and arranged downstream of said filling station with respect to said forwarding direction, a first air flow generator, for generating a first substantially horizontal laminar flow of sterilized air, fit to effect constantly at least the upper edges defining corresponding input mouths of said phials, at least during said phials filling and closing phases, as well as during their transfer between said filling station and said closing station; and, a second air flow generator located outside said first sterile chamber, fit to create a second vertical laminar flow of sterilized air oriented top-down, which effects at least the upper edges defining corresponding input mouths of said phials, when said phials are empty and being transported from an input line to the portion of the ring conveyor disposed in the second sterile chamber, and when said filled and closed phials are being transported from the ring conveyor to a second output conveying line.

4. Apparatus according to claim 3, wherein said second laminar flow of sterilized air created by said second air flow generator moreover effects at least said upper edges of said phials, when filled and closed, transported by said line between a second intermediate section, located at said opening, and an output section.

5. Apparatus according to claim 3, wherein said filling station comprises a telescopically adjustable tower carrying a dosing disc fit to put said dosed amount of pharmaceutical products inside each of said phials positioned at the filling station.

6. Apparatus according to claim 3, wherein said first laminar flow of sterilized air, created by said first air flow generator, is oriented horizontally.

* * * * *